US011736856B2

(12) United States Patent
Wang et al.

(10) Patent No.: US 11,736,856 B2
(45) Date of Patent: Aug. 22, 2023

(54) EARPHONE DEVICE

(71) Applicant: Jabil Circuit (Singapore) Pte. Ltd., Singapore (SG)

(72) Inventors: Wen-Hong Wang, Taichung (TW); Ching-Feng Lin, Taichung (TW); Chia-Chien Chen, Taichung (TW); Po-Cheng Huang, Taichung (TW); Shih-Hsien Yang, Taichung (TW); Cheng-Kun Chiang, Taichung (TW); Ching-Hsin Chen, Taichung (TW); Ching-Chieh Lin, Taichung (TW); Che-Hao Liao, Taichung (TW)

(73) Assignee: Jabil Circuit (Singapore) Pte. Ltd., Singapore (SG)

( * ) Notice: Subject to any disclaimer, the term of this patent is extended or adjusted under 35 U.S.C. 154(b) by 31 days.

(21) Appl. No.: 17/510,477

(22) Filed: Oct. 26, 2021

(65) Prior Publication Data

US 2022/0141570 A1 May 5, 2022

(30) Foreign Application Priority Data

Oct. 29, 2020 (CN) ..... 202022458115.9

(51) Int. Cl.
*H04R 1/10* (2006.01)
*H04R 25/00* (2006.01)

(52) U.S. Cl.
CPC ..... *H04R 1/1075* (2013.01); *H04R 1/1016* (2013.01); *H04R 1/1025* (2013.01); *H04R 1/1041* (2013.01)

(58) Field of Classification Search
CPC .. H04R 1/1075; H04R 1/1016; H04R 1/1025; H04R 1/1041
USPC ..... 381/74, 312
See application file for complete search history.

(56) References Cited

U.S. PATENT DOCUMENTS

| | | | | |
|---|---|---|---|---|
| 2009/0041284 | A1* | 2/2009 | Tanaka | H04R 1/1016 381/370 |
| 2016/0142807 | A1* | 5/2016 | Aase | H04R 1/1016 381/373 |
| 2020/0213787 | A1* | 7/2020 | Houcek | H04R 1/1033 |
| 2022/0103928 | A1* | 3/2022 | Staerke | H04R 25/656 |

FOREIGN PATENT DOCUMENTS

| | | | |
|---|---|---|---|
| CN | 201298912 | Y | 8/2009 |
| CN | 104231519 | A | 12/2014 |

* cited by examiner

*Primary Examiner* — Ammar T Hamid
(74) *Attorney, Agent, or Firm* — Young Basile Hanlon & MacFarlane, P.C.

(57) ABSTRACT

An earphone device includes a speaker unit, an inner housing body and an outer housing body. The inner housing body covers the speaker unit through an insert molding technique. The outer housing body covers the inner housing body through the insert molding technique.

17 Claims, 4 Drawing Sheets

EARPHONE DEVICE

CROSS-REFERENCE TO RELATED APPLICATION

This application claims priority to Chinese Utility Model Patent Application No. 202022458115.9, filed on Oct. 29, 2020.

FIELD

The disclosure relates to an earphone device, and more particularly to an earphone device involving an insert molding technique.

BACKGROUND

A conventional earphone device includes a housing member and a plurality of electronic components covered by the housing member. The housing member is generally manufactured by a plastic preform (i.e., a plastic semi-finished product) with high hardness. However, the housing member with high hardness may protect the electronic components from damage caused by, for example, a compression force or abrasion, but it may not reduce a damaging effect upon the electronic components when an impact force is applied on the conventional earphone device.

In addition, the housing member and the electronic components are generally joined together through an ultrasonic welding technique or an adhesive dispensing process. Consequently, for the conventional earphone device that has been assembled, when any of the electronic components needs to be replaced after inspection, the component replacement and rework thereof may be difficult.

SUMMARY

Therefore, an object of the disclosure is to provide an earphone device that can alleviate at least one of the drawbacks of the prior art.

According to an aspect of the disclosure, the earphone device includes a speaker unit, an inner housing body and an outer housing body. The inner housing body covers the speaker unit through an insert molding technique. The outer housing body covers the inner housing body through the insert molding technique.

According to another aspect of the disclosure, the earphone device includes a plurality of electronic components, an inner housing body and an outer housing body. The electronic components are electrically coupled to each other. The inner housing body includes at least two housing members respectively covering two of the electronic components through an insert molding technique. The outer housing body covers the at least two housing members through the insert molding technique.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
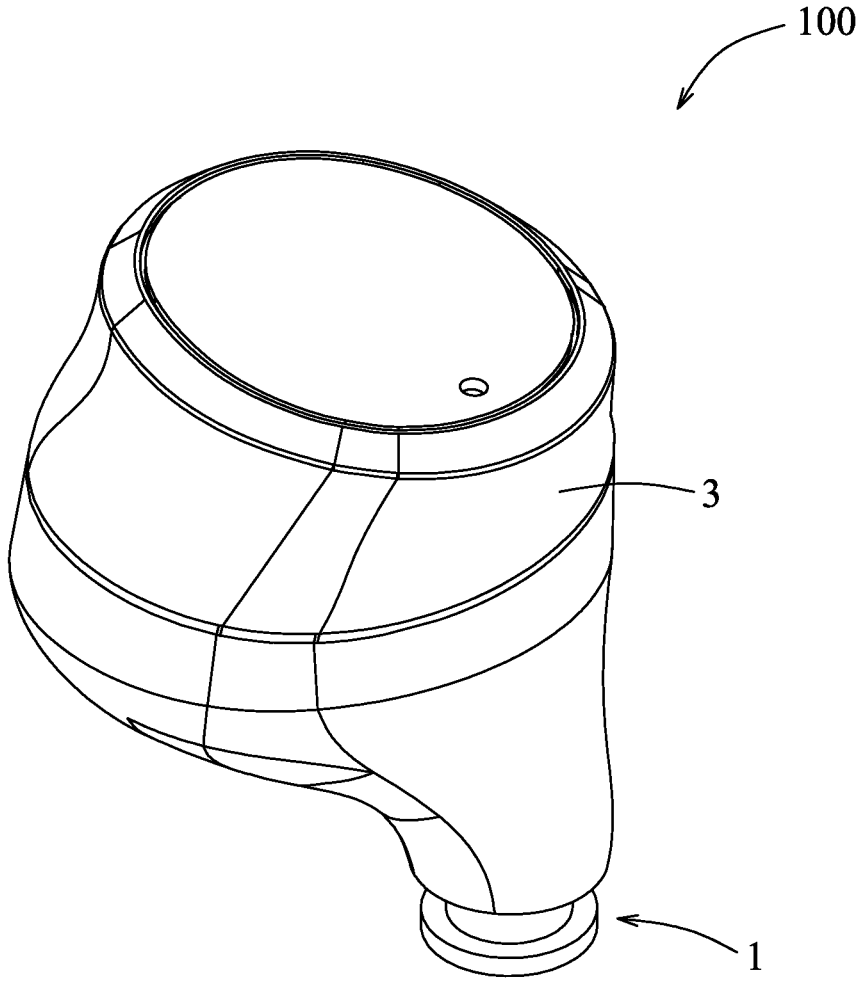
FIG. 1 is a perspective view of an embodiment of an earphone device according to the disclosure.
Figure 2:
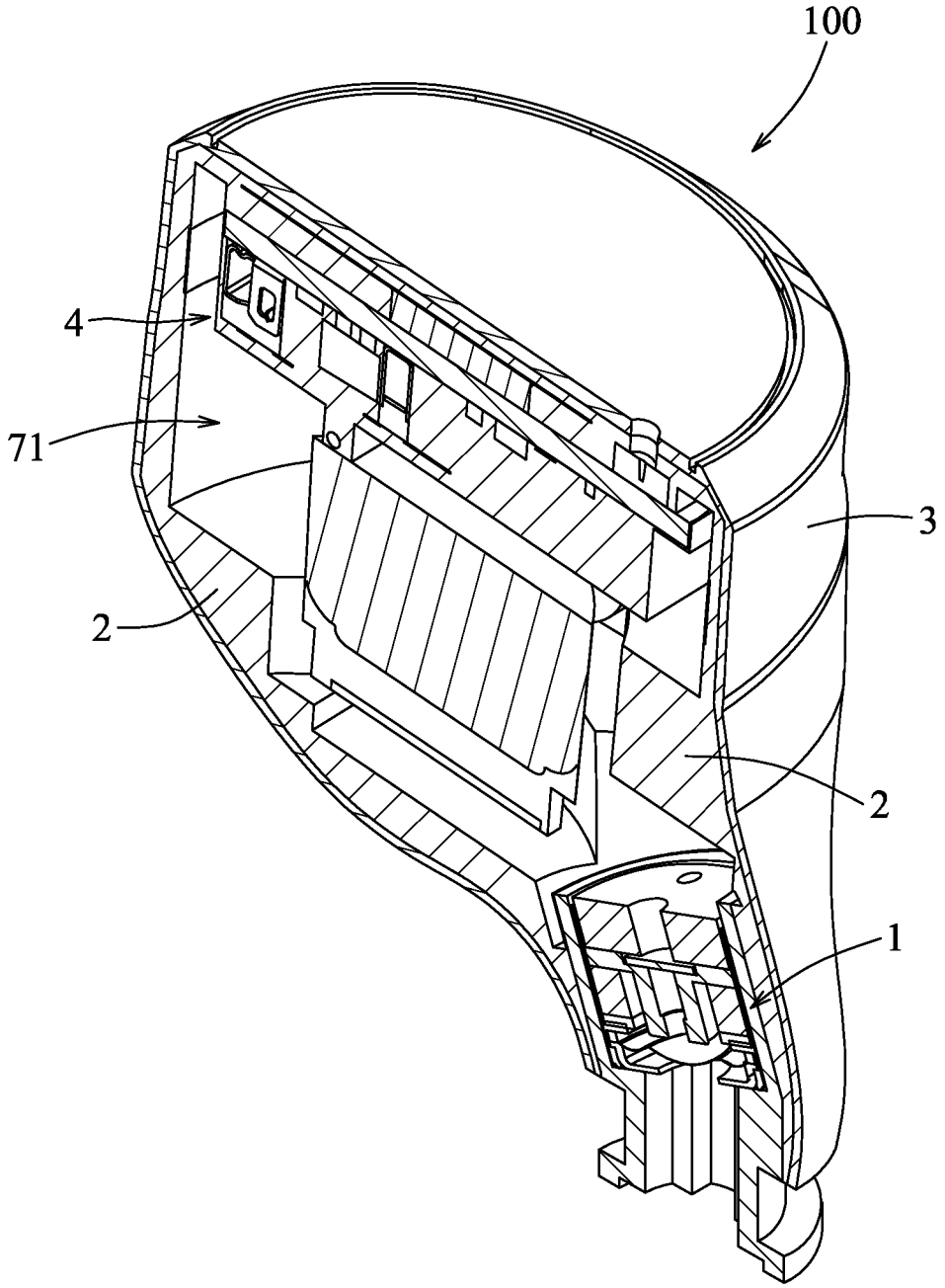
FIG. 2 is a cutaway perspective view of the embodiment.
Figure 3:
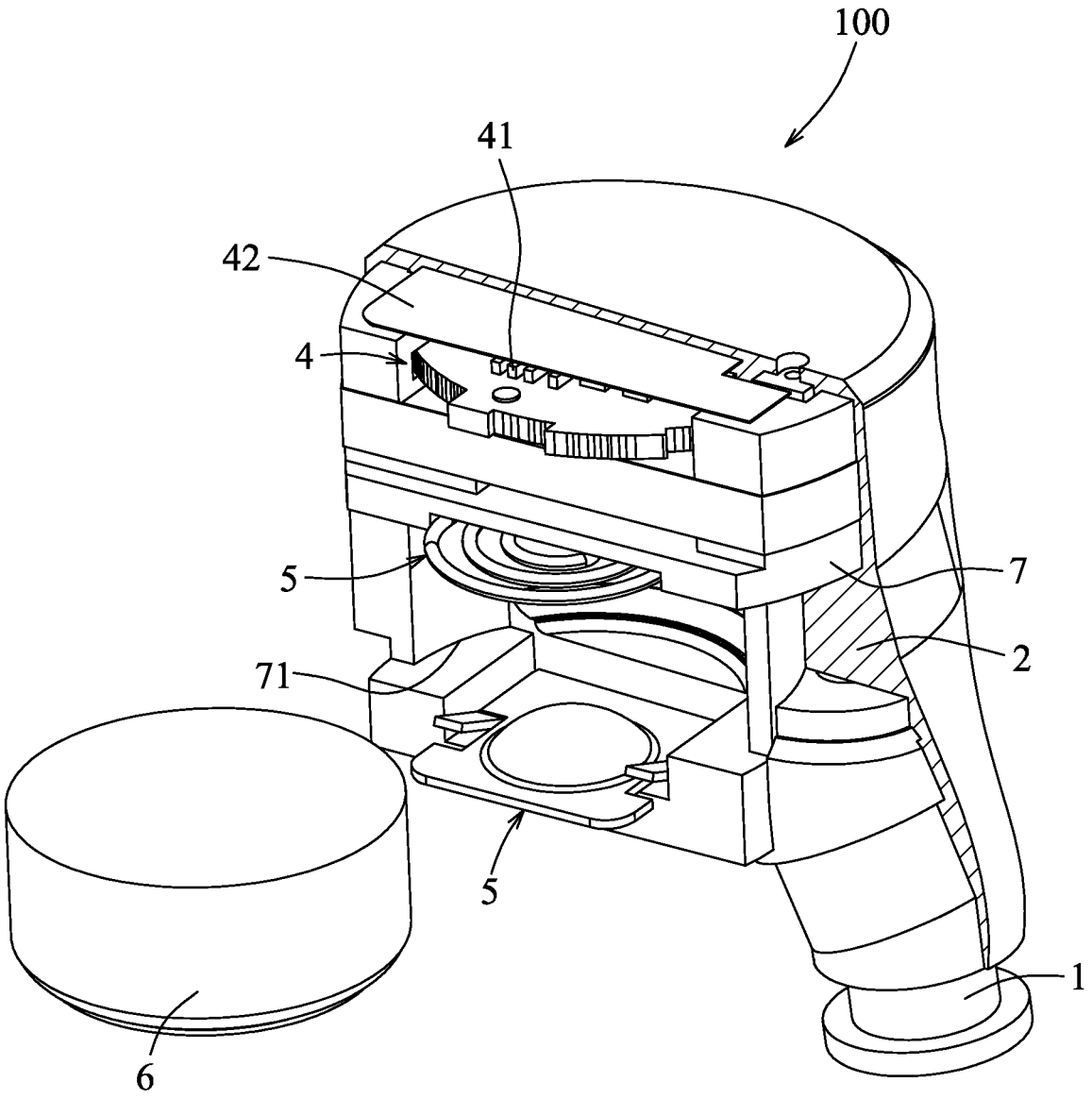
FIG. 3 is a partly exploded cutaway perspective view of the embodiment.

Referring to FIGS. 1 to 3, an embodiment of an earphone device 100 according to the disclosure includes a plurality of electronic components, an inner housing body 2, an outer housing body 3 and an accommodating base 7. The electronic components are electrically coupled to each other, and include a speaker unit 1. The speaker unit 1 includes a speaker and a speaker frame that covers the speaker. The inner housing body 2 covers the speaker unit 1 through an insert molding technique. The outer housing body 3 covers the inner housing body 2 through the insert molding technique. It is noted that, in this embodiment, the inner housing body 2 partially covers the speaker unit 1.

In this embodiment, the earphone device 100 uses a wireless canalphone, which is one type of earphones, as an example for description, and further includes a battery 6. However, in certain embodiments, the earphone device 100 may be other types of earphones. The electronic components of the earphone device 100 further include an electrical circuit module 4 and a pair of electrodes 5. The electrical circuit module 4 may include, but not limited to, a touch foil 42, wireless communication members (not shown), a circuit board 41 and necessary members (not shown) that are disposed on the circuit board 41 and which are required for operation of a common earphone device. In this embodiment, each of the speaker unit 1, the electrical circuit module 4 and the pair of the electrodes 5 is covered by the inner housing body 2 through the insert molding technique. However, in certain embodiments, the inner housing body 2 may include at least two of the following electronic components: the speaker unit 1, the electrical circuit module 4 and the pair of the electrodes 5.

The accommodating base 7 is covered by the inner housing body 2 through the insert molding technique, and is formed with an inner space 71 therein. Specifically, the speaker unit 1, the electrical circuit module 4 and the pair of the electrodes 5 are mounted to the accommodating base 7, and then the speaker unit 1, the electrical circuit module 4, the pair of the electrodes 5 and the accommodating base 7 are covered together by the inner housing body 2 through the insert molding technique so that the speaker unit 1, the electrical circuit module 4 and the pair of the electrodes 5 are prevented from misalignment. That is to say, the speaker unit 1, the electrical circuit module 4 and the pair of the electrodes 5 are mounted to the accommodating base 7 before they are covered by the inner housing body 2 through the insert molding technique. Afterwards, the battery 6 is disposed in the inner space 71 of the accommodating base 7. The electrodes 5 are exposed to the inner space 71 of the accommodating base 7, are located at two opposite sides of the battery 6, and are in electrical contact with the battery 6 so that the battery 6 is electrically coupled to the electrical circuit module 4. That is to say, the speaker unit 1, the electrical circuit module 4, the pair of the electrodes 5 and the battery 6 are electrically coupled. Because the battery 6 is disposed in the inner space 71 of the accommodating base 7 after a process using the insert molding technique, the battery 6 is prevented from being damaged by the relatively high temperature or pressure conditions of the process, and a rework thereof is relatively easy if it needs to be replaced after inspection.

In this embodiment, the inner housing body 2 is made from a liquid silicone rubber material that is resistant to corrosion and chemicals, that is chemically inert and hypoallergenic, and that is a common material for products which are in contact with the human skin during use, such as medical devices and baby products. The outer housing body 3 is made of a thermoplastic material whose hardness is greater than the inner housing body 2. However, in certain embodiments, the outer housing body 3 may be made from a liquid silicone rubber material whose hardness is greater than the inner housing body 2. Therefore, when an impact force is applied on the earphone device 100, the inner housing body 2 that has lower hardness may serve as a cushion to reduce damaging impacts upon the speaker unit 1, the electrical circuit module 4 and the pair of the electrodes 5, so that the speaker unit 1, the electrical circuit module 4 and the pair of the electrodes 5 are prevented from malfunctioning. In addition, in certain embodiments, the inner housing body 2 may be made of a thermoplastic material, or may be made from a liquid silicone rubber material whose hardness is greater than the outer housing body 3, which is made from either a liquid silicone rubber material or a thermoplastic material. In those embodiments, the outer housing body 3 directly absorbs the energy of an impact force, and the hardness of the inner housing body 2 provides a relatively high impact strength to protect the loudspeaker 1, the electrical circuit module 4 and the pair of the electrodes 5. That is to say, by virtue of the hardness of the outer housing body 3 being different from that of the inner housing body 2, the inner housing body 2 and the outer housing body 3 cooperatively protect the speaker unit 1, the electrical circuit module 4 and the pair of the electrodes 5. Furthermore, the outer housing body 3 protects the inner housing body 2 and defines a shape of the earphone device 100. In this embodiment, the shape is in a general shape of a wireless canalphone. However, in certain embodiments, the shape of the earphone device 100 may be different from that of this embodiment.

Figure 4:
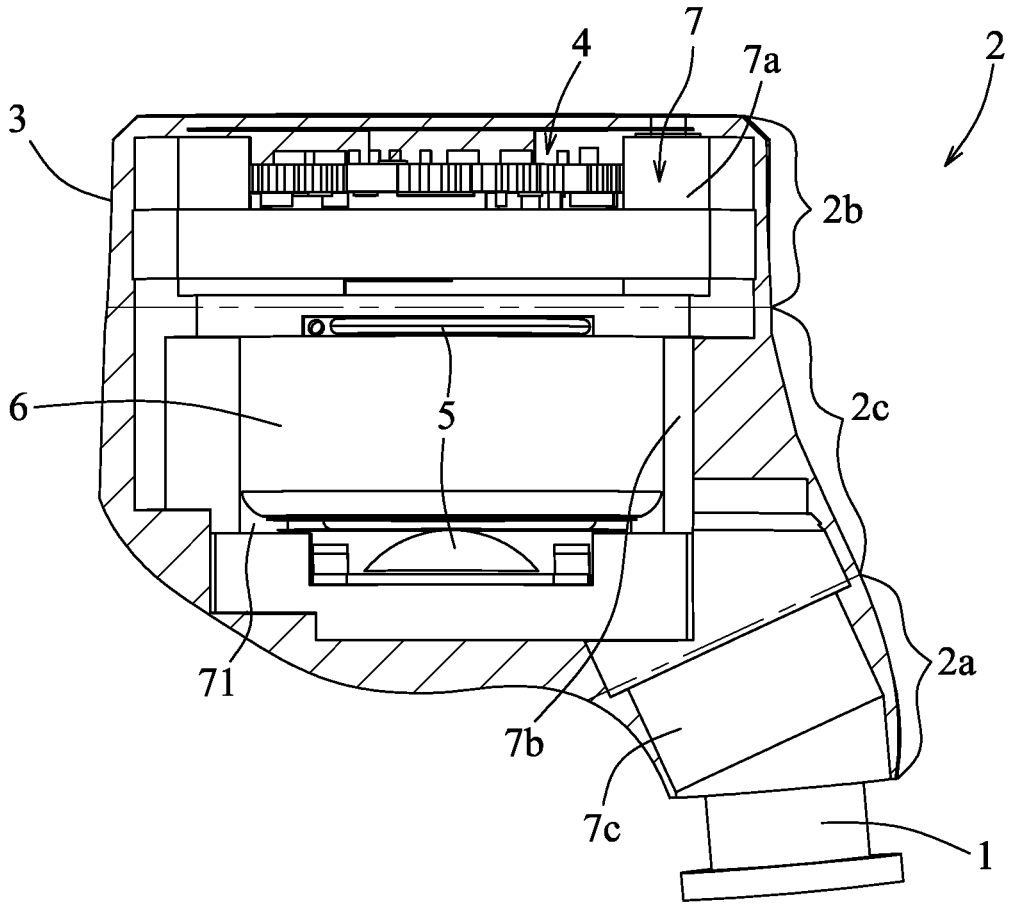
FIG. 4 is a sectional view of another example of the embodiment.

Referring to FIG. 4, the inner housing body 2 of another configuration of the embodiment includes a first housing member 2*a*, a second housing member 2*b* and a third housing member 2*c* that are separable from each other. The first housing member 2*a*, the second housing member 2*b* and the third housing member 2*c* respectively cover the speaker unit 1, the electrical circuit module 4 and the pair of the electrodes 5 through the insert molding technique. Afterwards, the first housing member 2*a*, the second housing member 2*b*, the third housing member 2*c* and the battery 6 are covered by the outer housing body 3 through the insert molding technique. Specifically, in this configuration, the earphone device 100 may further include, for example, an electrical connector (not shown) to keep the speaker unit 1 and the electrical circuit module 4 electrically coupled even though the speaker unit 1 and the electrical circuit module 4 are respectively covered by the first housing member 2*a* and the second housing member 2*b* that are separable. It is noted that, in certain embodiments, the inner housing body 2 may include at least two housing members that respectively cover two of the electronic components (i.e., two of the speaker unit 1, the electrical circuit module 4 and the pair of the electrodes 5) through the insert molding technique, and the outer housing body 3 covers the at least two housing members through the insert molding technique. Therefore, in addition to the impact reducing effect that the earphone device 100 achieves, by virtue of the inner housing body 2 including the abovementioned separable members in this configuration, when a rework of any one of the speaker unit 1, the electrical circuit module 4 and the pair of the electrodes 5 is needed, the rework can be conducted simply by removing the outer housing body 3, which is relatively easy.

In the configuration of the embodiment that the inner housing body 2 includes the first housing member 2*a*, the second housing member 2*b* and the third housing member 2*c* that are separable from each other, the accommodating base 7 may include a first base 7*a*, a second base 7*b* and a third base 7*c* that respectively correspond in position to the first housing member 2*a*, the second housing member 2*b* and the third housing member 2*c*, and that are separable from each other. In this configuration, the third base 7*c* is formed with the inner space 71. The speaker unit 1, the electrical circuit module 4 and the pair of the electrodes 5 are respectively mounted to the first base 7*a*, the second base 7*b* and the third base 7*c* of the accommodating base 7 before they are respectively covered by the first housing member 2*a*, the second housing member 2*b* and the third housing member 2*c* of the inner housing body 2 through the insert molding technique. In a modification, the accommodating base 7 may be omitted.

In summary, by virtue of the speaker unit 1 being covered by the inner housing body 2 through the insert molding technique, and by virtue of the inner housing body 2 being covered by the outer housing body 3 through the insert molding technique, the earphone device 100 gives the speaker unit 1 better protection than a conventional earphone device with only one shell made of a hard material. Furthermore, by virtue of the electronic components being respectively covered by the housing members 2*a*, 2*b*, 2*c* of the inner housing body 2 through the insert molding technique, and by virtue of the housing members 2*a*, 2*b*, 2*c* being covered by the outer housing body 3 through the insert molding technique, a rework of any one of the electronic components can be conducted when the outer housing body 3 is removed, which brings less disturbance to the rest of the electronic components and makes the rework relatively easy. Therefore, the object of the embodiment is indeed achieved.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An earphone device comprising:

a speaker unit;

an inner housing body covering said speaker unit through an insert molding technique; and an outer housing body covering said inner housing body through the insert molding technique.

2. The earphone device as claimed in claim 1, further comprising an electrical circuit module that is electrically coupled to said speaker unit, said inner housing body including a first housing member and a second housing member that are separable from each other, said first housing member and said second housing member respectively covering said speaker unit and said electrical circuit module through the insert molding technique.

3. The earphone device as claimed in claim 1, further comprising a battery and an accommodating base, said inner housing body covering said accommodating base through the insert molding technique, said accommodating base being formed with an inner space, therein, said battery being disposed in said inner space.

4. The earphone device as claimed in claim 3, further comprising an electrical circuit module that is electrically coupled to said speaker unit, and a pair of electrodes that are electrically coupled to said electrical circuit module, said electrical circuit module and said pair of said electrodes being mounted to said accommodating base before covered by said inner housing body through the insert molding technique, said pair of said electrodes being exposed to said inner space of said accommodating base, and being in electrical contact with said battery so that said battery is electrically coupled to said electrical circuit module.

5. The earphone device as claimed in claim 1, wherein at least one of said inner housing body and said outer housing body is made from a liquid silicone rubber material.

6. The earphone device as claimed in claim 1, wherein a hardness of said outer housing body is different from that of said inner housing body.

7. The earphone device as claimed in claim 1, wherein said outer housing body defines a shape of said earphone device.

8. The earphone device as claimed in claim 1, wherein at least one of said inner housing body and said outer housing body is made of a thermoplastic material.

9. An earphone device comprising:

a plurality of electronic components electrically coupled to each other;

an inner housing body including at least two housing members that respectively cover at least two of said electronic components through an insert molding technique; and an outer housing body covering said at least two housing members through the insert molding technique.

10. The earphone device as claimed in claim 9, wherein said electronic components includes a speaker unit, an electrical circuit module and a pair of electrodes.

11. The earphone device as claimed in claim 10, wherein said at least two housing members of said inner housing body includes a first housing member and a second housing member separable from each other, said first housing member and said second housing member respectively covering said speaker unit and said electrical circuit module through the insert molding technique.

12. The earphone device as claimed in claim 10, further comprising a battery and an accommodating base, said inner housing body covering said accommodating base through the insert molding technique, said accommodating base being formed with an inner space therein, said battery being disposed in said inner space.

13. The earphone device as claimed in claim 12, wherein said electrical circuit module and said pair of said electrodes are mounted to said accommodating base before covered by said inner housing body through the insert molding technique, said pair of said electrodes being exposed to said inner space of said accommodating base, and being in electrical contact with said battery so that said battery is electrically coupled to said electrical circuit module.

14. The earphone device as claimed in claim 9, wherein at least one of said inner housing body and said outer housing body is made from a liquid silicone rubber material.

15. The earphone device as claimed in claim 9, wherein a hardness of said outer housing body is different from that of said inner housing body.

16. The earphone device as claimed in claim 9, wherein said outer housing body defines a shape of said earphone device.

17. The earphone device as claimed in claim 9, wherein at least one of said inner housing body and said outer housing body is made of a thermoplastic material.

* * * * *